US005488461A

United States Patent [19]

Go et al.

[11] Patent Number: 5,488,461

[45] Date of Patent: Jan. 30, 1996

[54] ELECTROPHOTOGRAPHIC PHOTOSENSITIVE MEMBER AND ELECTROPHOTOGRAPHIC APPARATUS USING THE SAME

[75] Inventors: Shintetsu Go; Yoshio Kashizaki, both of Yokohama; Koichi Suzuki, Kawasaki; Kazuma Sato, Yokohama; Akira Shimada, Tokyo, all of Japan

[73] Assignee: Canon Kabushiki Kaisha, Tokyo, Japan

[21] Appl. No.: 400,007

[22] Filed: Mar. 6, 1995

Related U.S. Application Data

[63] Continuation of Ser. No. 148,337, Nov. 8, 1993, abandoned.

[30] Foreign Application Priority Data

Nov. 6, 1992 [JP] Japan ..... 4-297249

[51] Int. Cl.[6] ..... G03G 5/00; G03G 7/00

[52] U.S. Cl. ..... 355/211; 355/212; 430/56; 430/57; 430/60; 430/62; 430/64

[58] Field of Search ..... 358/211, 212; 430/56, 57, 60, 61, 62, 63, 64, 65

[56] References Cited

U.S. PATENT DOCUMENTS

| | | | |
|---|---|---|---|
| 4,281,052 | 7/1981 | Ito et al. | 430/60 X |
| 4,416,963 | 11/1983 | Takimoto et al. | 430/63 X |
| 4,426,435 | 1/1984 | Oka | 430/66 X |
| 4,579,801 | 4/1986 | Yashiki | 430/60 |
| 4,618,552 | 10/1986 | Tanaka et al. | 430/60 |
| 4,657,835 | 4/1987 | Yashiki | 430/60 |
| 4,904,557 | 2/1990 | Kubo | 430/56 |
| 4,949,690 | 8/1990 | Hisamura et al. | 430/60 |
| 5,215,839 | 6/1993 | Yu | 430/62 X |

FOREIGN PATENT DOCUMENTS

| | | | |
|---|---|---|---|
| 0510538 | 10/1992 | European Pat. Off. . | |
| 3428407 | 2/1985 | Germany . | |
| 54-151843 | 11/1979 | Japan | G03G 5/14 |
| 58-181054 | 10/1983 | Japan | G03G 5/14 |
| 1-118848 | 5/1989 | Japan | G03G 5/14 |

*Primary Examiner*—Matthew S. Smith

*Attorney, Agent, or Firm*—Fitzpatrick, Cella, Harper & Scinto

[57] ABSTRACT

An electrophotographic photosensitive member, having a support, and an intermediate layer and a photosensitive layer disposed on the support in this order; the intermediate layer having a coated powder comprising a coating layer and barium sulfate fine particles coated with the coating layer; and the coating layer comprising tin oxide. The above intermediate layer is usable for constituting an electrophotographic apparatus providing stable potential properties and good image quality under overall environmental conditions including low-temperature and low-humidity condition to high-temperature and high-humidity condition.

34 Claims, 1 Drawing Sheet

ELECTROPHOTOGRAPHIC PHOTOSENSITIVE MEMBER AND ELECTROPHOTOGRAPHIC APPARATUS USING THE SAME

This application is a continuation of application Ser. No. 08/148,337 filed Nov. 8, 1993, now abandoned.

FIELD OF THE INVENTION AND RELATED ART

The present invention relates to an electrophotographic photosensitive member, particularly to an electrophotographic photosensitive member (hereinbelow, simply referred to as "photosensitive member") having a specific intermediate layer.

The present invention also relates to an electrophotographic apparatus using the photosensitive member.

A photosensitive member is generally constituted by a support and photosensitive layer (or a photoconductive layer) formed on the support. The photosensitive member may further contain an intermediate layer disposed between the photosensitive layer and the support since the intermediate layer is effective for covering defects of the support, protecting the photosensitive layer from an electrical breakdown, and improving various properties such as coating properties of the photosensitive layer. adhesive properties between the photosensitive layer and the support, charging characteristic, and charge-injecting properties from the support to the photosensitive layer. Accordingly, the intermediate layer for use in the photosensitive member is required to have various functions such as coating properties, adhesive properties, mechanical strength, appropriate conductivity and electrical barrier properties.

Heretofore, there have been proposed intermediate layers including:

(i) a resin film free from a conductive filler, (ii) a resin film containing a conductive filler, and (iii) a laminated film comprising a layer of the above resin film (i) laminated on a layer of the above film (ii).

However, the layer of the above resin film (i) has a high resistivity because the layer does not contain a conductive filler, and is required to have a large thickness in order to reedy defects on a support. Therefore, the layer of (i) has the disadvantage of an increased residual potential with repetitive use, thus requiring a considerably small thickness by minimizing the defects on the support in order to put the layer of (i) to practical use.

On the other hand, the layers of the above resin films (ii) and (iii) have the advantage of having an appropriate conductivity by dispersing a conductive filler therein. Such layers of (ii) and (iii), however, change their electrical characteristics such as resistivity and permittivity (or dielectric constant) if the conductive filler has poor dispersibility, thus adversely affecting potential properties and image forming properties. In this instance, the layers of (ii) and (iii) also have a poor surface smoothness to cause coating defects and further invite decreases in adhesive properties and mechanical strength.

There have been proposed some conductive fillers for use in an intermediate layer, such as metal, metal oxide and metal nitride, in Japanese Laid-Open Patent Applications Nos. 58-181054 (for metal), 54-151843 (for metal oxide), 1-118848 (for metal nitride), etc.

However, when such conventional conductive fillers were used as those for use in intermediate layers, the intermediate layers encountered a difficulty in preparing a photosensitive member providing always stable potential properties and image forming properties under overall environmental conditions including low-temperature and low-humidity condition to high-temperature and high-humidity condition because such intermediate layers had large environment-dependences of potential properties such as temperature-dependence and humidity-dependence. For instance, under low-temperature and low-humidity condition inviting an increase in a volume resistivity of an intermediate layer, charges were accumulated in the intermediate layer to increase a residual potential and a light part potential when a photosensitive member having the intermediate layer was repetitively used. On the other hand, when a photosensitive member having an intermediate layer was repetitively used under high-temperature and high-humidity condition inviting a decrease in a volume resistivity of the intermediate layer, an electrical barrier function of the intermediate layer was lowered to accelerate a carrier injection from a support to the intermediate layer, thus resulting in a decrease in a dark part potential of a photosensitive member having the intermediate layer to cause a decrease in an image density. When such photosensitive member was used for a printer utilizing an electrophotographic system performing reversal development, it was liable to cause undesirable black spots and fog with respect to a resulting image.

The reason why electrophotographic properties of a photosensitive member are changed depending upon environmental conditions as described above may be attributable to a poor dispersibility of a conductive filler used. In other words, when a dispersibility of a conductive filler within an intermediate layer is lowered, there occurs a local change in a resistivity, whereby potential properties and image forming properties of a photosensitive member having the intermediate layer are presumably changed under the influence of environmental conditions.

SUMMARY OF THE INVENTION

An object of the present invention is to provide an electrophotographic photosensitive member having stable potential properties and good image forming properties under overall environmental conditions including low-temperature and low-humidity condition to high-temperature and high-humidity condition.

Another object of the present invention is to provide an electrophotographic apparatus using the photosensitive member.

According to the present invention, there is provided an electrophotographic photosensitive member, comprising: a support, and an intermediate layer and a photosensitive layer disposed on the support in this order;

the intermediate layer comprising: a coated powder comprising a coating layer and barium sulfate fine particles coated with the coating layer; and the coating layer comprising tin oxide.

According to the present invention, there is also provided an electrophotographic apparatus, comprising: an electrophotographic photosensitive member according to claim 1, charging means for charging the photosensitive member, image exposure means for performing image exposure to the charged photosensitive member to form an electrostatic latent image on the photosensitive member, and developing means for developing the latent image with a toner.

These and other objects, features and advantages of the present invention will become more apparent upon a consideration of the following description of the preferred embodiments of the present invention taken in conjunction with the accompanying drawing.

DETAILED DESCRIPTION OF THE INVENTION

Figure 1:
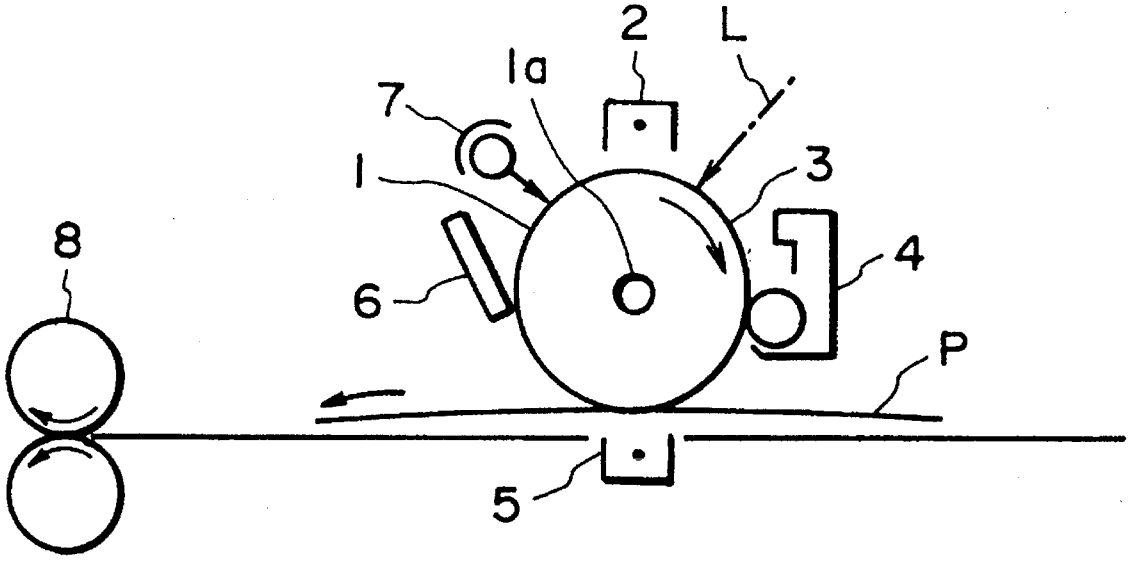
FIGURE 1 is a schematic structural view of an embodiment of electrophotographic apparatus using an electrophotographic photosensitive member according to the present invention.

The electrophotographic photosensitive member according to the present invention comprises a support, and an intermediate layer and a photosensitive layer disposed on the support in this order. The intermediate layer of the photosensitive member of the present invention is characterized by containing a binder resin and a coated powder as a filler comprising a conductive coating layer comprising tin oxide and barium sulfate fine particles coated with the coating layer.

The barium sulfate fine particles are excellent in dispersibility and have a refractive index substantially equal to a refractive index of the binder resin used, thus not hindering light transmission properties of the intermediate layer.

In the present invention, by coating barium sulfate fine particles with a conductive coating layer, a resultant coated powder has an appropriate resistivity (or specific resistance). The coated powder may preferably have a resistivity (herein, referred to as "powder resistivity") of 0.1 ohm.cm to 1000 ohm.cm, particularly 1 ohm.cm to 1000 ohm.cm.

Herein, a resistivity of a coated powder (i.e., powder resistivity) can be measured by a resistance measuring apparatus (Loresta AP, manufactured by Mitsubishi Yuka K.K.). More specifically, a coin-like sample is prepared by compressing a powder under a pressure of 500 kg/cm$^2$ and is mounted or disposed on a prescribed position of the apparatus.

The coating layer of the filler used in the present invention may preferably have a coating ratio of 10–80 wt. %, more preferably 30–60 wt. %. Herein, the term "coating ratio" means a ratio of a total weight of a coating layer comprising tin oxide used in a coated powder to a total weight of the coated powder comprising the coating layer and barium sulfate fine particles (i.e., a weight percentage of the total coating layer contained in the total coated powder).

The coated powder may preferably have an average particle size of 0.05–1.0 μm, more preferably 0.07–0.7 μm. Herein, the average particle size of the filler (coated powder) means a value of that measured according to a centrifugal sedimentation method.

In general, as an average particle size of a filler is decreased, the filler is liable to cause reagglomeration or reaggregation because it becomes difficult to disperse the filler. The filler used in the present invention is improved in dispersibility. In the present invention, a filler content of the intermediate layer may preferably be 1.0–90 wt. %, more preferably 5.0–80 wt. %.

The coating layer may further contain fluorine or antimony. In this instance, such a coating layer comprises a solid solution comprising a crystal lattice of tin oxide at which a prescribed amount of a fluorine atom or antimony atom is incorporated into the crystal lattice. By incorporating such a fluorine atom or an antimony atom into the coating layer, it is possible to decrease a resistivity of the coating layer. The coating layer may preferably comprise 0.01–30 wt. %, more preferably 0.1–10 wt. %, of fluorine or antimony. In order to decrease a resistivity of the coating layer, it is also possible to decrease an oxygen content of tin oxide used in the coating layer by a reduction process.

Examples of the binder resin used for the intermediate layer may include polymers or resins such as phenolic resin, polyurethane resin, polyamide, polyimide, polyamide-imide, polyamide acid resin, polyvinyl acetal, epoxy resin, acrylic resin, melamine resin and polyester. The above binder resins may be used singly or in combination of two or more species. The binder resin used in the intermediate layer has the advantages of improving a dispersibility of the filler and having a good solvent resistance after film formation in addition to good adhesive properties to the support. Among the above-mentioned resins, phenolic resin, polyurethane resin and polyamide acid resin may particularly be preferred.

The intermediate layer constituting the photosensitive member of the present invention may preferably be prepared by applying a solution or a dispersion comprising a coated powder, a binder resin and an appropriate solvent onto a support by known coating methods such as dipping and bar coating, followed by drying.

In order to improve a dispersibility of the filler used in the present invention, the surface of the present invention may be treated with a treating agent including: a coupling agent such as a silane coupling agent or titanium coupling agent, and a silicone oil.

The intermediate layer may preferably have a thickness of 0.1–30 μm, more preferably 0.5–10 μm. The intermediate layer may preferably have a volume resistivity of at most $10^{13}$ ohm.cm, particularly at most $10^{12}$ ohm.cm.

A volume resistivity of an intermediate layer can be measured as follows.

A sample of an intermediate layer is applied onto an aluminum plate. On the coated aluminum plate, a thin film of gold is formed. A value of a current carried between the aluminum plate (as an electrode) and the gold thin film (as an electrode) is measured by using a pA meter to obtain a volume resistivity.

The intermediate layer may further contain another filler in addition to the above-mentioned filler (i.e., coated powder). Examples of such another filler may include zinc oxide, titanium oxide, etc. The intermediate layer may also contain a leveling agent so as to enhance a surface smoothness of the intermediate layer.

Then, a layer structure of the photosensitive layer used in the present invention will be explained. The photosensitive layer may be constituted by a single layer and may also have a laminated structure including at least a charge generation layer (herein, referred to as "CGL") and a charge transport layer (herein, referred to as "CTL").

In case where the photosensitive layer is constituted by the single layer, a charge-generating substance (herein, referred to as "CGS") and a charge-transporting substance (herein, referred to as "CTS") are contained in a single layer wherein generation and transport (or migration) of a photocarrier (or charge carrier) are performed.

In case where the photosensitive layer has the laminated layer, a CGL containing a CGS and a CTL containing a CTS may be disposed on a support in this order or in reverse order.

Examples of the CGS may include: azo pigments such as those of monoazo-type, bisazo-type and trisazo-type; metallo- or nonmetallo-phthalocyanine pigments; indigo pigments such as indigo and thioindigo; quinone pigments such as anthraquinone and pyrenequinone; perylene pigments such as perylene acid anhydride and perylene acid imide; squarium pigment; pyrylium salts or thiopyrylium salts; and triphenylmethane dyes. In addition, it is possible to use inorganic materials, such as selenium, selenium-tellurium and amorphous silicon, as the CGS.

The CTS includes an electron-transporting substance and a hole-transporting substance.

Examples of the electron-transporting substance may include: 2,4,7-trinitrofluorenone, 2,4,5,7-tetranitrofluorenone, chloranil or tetracyanoquinone-dimethane.

Examples of the hole-transporting substance may include: polycyclic aromatic compounds such as pyrene and anthracene; heterocyclic compounds such as carbazoles, indoles, imidazole, oxazoles, thiazoles, oxadiazoles, pyrazoles, pyrazolines, thiadiazoles and triazole; hydrazone compounds such as p-diethylamionobenzaldehyde-N,N-diphenylhydrazone and N,N-diphenylhydrazino-3-methylidene-9-ethylcarbazole; styryl-type compounds such as α-phenyl-4'-N,N-diaminostilbene and 5-[H-(di-p-tolylamino)benzylidene] -5H-dibenzo-[a,d]-dicycloheptene; benzidines; and triarylamines.

In formulating the photosensitive layer, when the photosensitive layer is composed of a single layer, the CGS and the CTS may preferably be contained in the photosensitive layer in amounts of 10–70 wt. respectively, particularly 20–70 wt. %, respectively. When the photosensitive layer has a laminated structure, the CGS may preferably be contained in the CGL in an amount of 10–100 wt. %, particularly 40–100 wt. %, and the CTS may preferably be contained in the CTL in an amount of 20–80 wt. %, particularly 30–70 wt. %.

A thickness of the photosensitive layer which is composed of a single layer may preferably be 5–100 microns, more preferably 10–60 microns. When the photosensitive layer has a laminated structure, a thickness of the CGL may preferably be 0.001–5 microns, more preferably 0.05–2 microns, and a thickness of the CTL may preferably be 1–40 microns, more preferably 10–30 microns.

The photosensitive member according to the present invention may be prepared by disposing a material for constituting the photosensitive layer on a support by a vapor-deposition or by applying a coating liquid containing such a material, an appropriate binder and/or an appropriate solvent onto a support and drying the resultant coating.

Examples of such a binder for use in the photosensitive member including those having the above-mentioned single layer and laminated structure may preferably include: polyvinyl acetal, polycarbonate, polystyrene, polyester, polyvinyl acetate, polymethacrylate, acrylic resin, and cellulosic resin.

Some materials for constituting the photosensitive layer affect injection of free carriers from the intermediate layer to the photosensitive layer, thus decreasing a chargeability of a resultant photosensitive member to adversely affect image properties. In this instance, it is possible to dispose a barrier layer (e.g., an appropriate resin film) having a barrier function between the intermediate layer and the photosensitive layer, as desired, thus effectively suppressing the injection of free carriers.

Examples of materials for use in the barrier layer may include: water-soluble resins such as polyvinyl alcohol, polyvinyl methyl ether, polyacrylic acid and its derivatives, methyl cellulose, ethyl cellulose, polyglutamic acid, casein, and starch; and resins or polymers such as polyamide, polyimide, polyamide-imide, polyamide acid resin, melamine resin, epoxy resin, polyurethane, and polyglutamate. In view of coating properties, adhesive properties, solvent resistance, electrical barrier function, electrical resistance, etc., polyamide may preferably be used as the barrier layer material. Such polyamide may preferably include copolymer nylon having a low crystallizability or non-crystallizability so as to allow application in a solution state.

The barrier layer may preferably have a thickness of 0.1–2 μm.

In the photosensitive member according to the present invention, it is possible to dispose a protective layer on the photosensitive layer. The protective layer may principally comprise resins or polymers such as polyester, polyurethane, polyarylate, polyethylene, polystyrene, polybutadiene, polycarbonate, polyamide, polypropylene, polyimide, polyamide-imide, polysulfone, polyarylether, polyacetal, nylon, phenolic resin, acrylic resin, silicone resin, epoxy resin, urea resin, allyl resin, alkyd resin, and butyral resin.

The protective layer may preferably have a thickness of 0.05–15 μm, more preferably 1–10 μm.

The support for use in the photosensitive member of the present invention may be prepared by using various materials including: metal or metal alloy, such as aluminum, aluminum alloy, copper, titanium, or stainless steel; a polymeric material such as polyethylene terephthalate, phenolic resin, polypropylene, or polystyrene; and hard or rigid paper. The support may preferably be in the form of a cylinder or drum, a belt, or a sheet. When the materials for the support have a high volume resistivity, the support is required to be subjected to conductive treatment. The conductive treatment can be performed by forming a conductive film layer on the support or by dispersing a conductive substance within the support.

The photosensitive member according to the present invention can be applied to not only an ordinary electrophotographic copying machine but also a laser beam printer, a cathode-ray tube (CRT) printer, a light-emitting diode (LED) printer, a liquid crystal printer, a facsimile machine, and other fields of applied electrophotography including, e.g., laser plate making.

Hereinbelow, an electrophotographic apparatus according to the present invention will be explained with reference to the sole figure.

FIGURE 1 shows a schematic structural view of an embodiment of an electrophotographic apparatus using an electrophotographic photosensitive member of the present invention. Referring to FIGURE 1, a photosensitive drum (i.e., photosensitive member) 1 is rotated about an axis la at a prescribed peripheral speed in the direction of the arrow shown inside of the photosensitive drum 1. The surface of the photosensitive drum is uniformly charged by means of a charger 2 to have a prescribed positive or negative potential. The photosensitive drum 1 is subjected to image exposure with light L (e.g., slit exposure or laser beam-scanning exposure) at a prescribed exposure part 3 by using an image exposure means (not shown), whereby an electrostatic latent image corresponding to an exposure image is successively formed on the peripheral surface of the photosensitive drum 1. The electrostatic latent image is developed by a developing means 4 with a toner to form a toner image. The toner image is successively transferred to a recording material P which is supplied from a supply part (not shown) to a position between the photosensitive drum 1 and a transfer charger 5 in synchronism with the rotating speed of the photosensitive drum 1, by means of the transfer charger 5. The recording material P with the toner image thereon is separated from the photosensitive drum 1 to be conveyed to a fixing device 8, followed by image fixing to print out the recording material P as a copy outside the electrophotographic apparatus. Residual toner particles on the surface of the photosensitive drum 1 after the transfer are removed by means of a cleaner 6 to provide a cleaned surface, and residual charge on the surface of the photosensitive drum 1 is erased by a pre-exposure means 7 to prepare for the next cycle. As the charger 2 for charging the photosensitive drum 1 uniformly, a corona charger is widely used in general. As the transfer charger 5, such a corona charger is also widely used in general.

According to the present invention, in the electrophotographic apparatus, it is possible to provide a device unit which includes plural means inclusive of or selected from the photosensitive member (photosensitive drum), the charger, the developing means, the cleaner, etc. so as to be attached or removed as desired. The device unit may, for example, be composed of the photosensitive member and the cleaner 6 to prepare a single unit capable of being attached to or removed from the body of the electrophotographic apparatus by using a guiding means such as a rail in the body. At this time, the device unit can be accompanied with the charger and/or the developing means to prepare a single unit.

In case where the electrophotographic apparatus is used as a copying machine or a printer, exposure light-image L may be effected by using reflection light or transmitted light from an original or by reading a data on the original by a sensor, converting the data into a signal and then effecting a laser beam scanning, a drive of LED array or a drive of a liquid crystal shutter array in accordance with the signal.

Hereinbelow, the present invention will be explained in more specifically with reference to examples. In the following examples, "part(s)" means "weight part(s)".

EXAMPLE 1

A coating liquid for an intermediate layer was prepared in the following manner.

A mixture of 120 parts of a coated powder comprising barium sulfate fine particles having a coating layer of tin oxide (particle size of 0.22 μm, coating ratio of 50 wt. %, powder resistivity of 700 ohm.cm), 70 parts of a resol-type phenolic resin (trade name: Plyophen J-325, manufactured by Dainippon Ink & Chemicals, Inc.; solid content of 70%), and 100 parts of 2-methoxy-1-propanol were dispersed for about 20 hours in a ball mill to prepare a coating liquid.

The coating liquid was applied onto an aluminum cylinder (outer diameter of 30 mm, length of 360 mm; surface roughness (Rmax) of 5 μm) by dipping, followed by drying for 30 minutes at 140° C. to form an intermediate layer having a thickness of 17 μm. The intermediate layer showed a surface roughness (Rmax) of 0.5 μm.

Herein, Rmax is obtained according to Japan Industrial Standard (JIS) B0601.

A solution of 10 parts of a copolymer nylon resin (Amilan CM 8000, mfd. by Toray K.K.) in a mixture solvent of 60 parts of methanol and 40 parts of butanol was applied onto the above-prepared intermediate layer by dipping, followed by drying of 10 minutes at 90° C. to form a barrier layer having a thickness of 0.5 μm.

Then, a mixture of 4 parts of an oxytitanium-phthalocyanine pigment, 2 parts of a polyvinyl butyral resin (BX-1, mfd. by Sekisui Kagaku Kogyo K.K.; butyral degree of 80%) and 34 parts of cyclohexanone was dispersed for 8 hours by a sand mill. To the resultant mixture, 60 parts of tetrahydrofuran was added, thus preparing a dispersion for a CGL. The dispersion was applied onto the above-prepared barrier layer by dipping, followed by drying for 10 minutes at 80° C. to form a CGL having a thickness of 0.2 μm.

Subsequently, 50 parts of a triarylamine compound represented by the following formula:

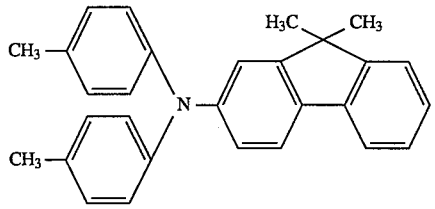

50 parts of a polycarbonate resin (Iupilon Z-200, mfd. by Mitsubishi Gas Kagaku K.K.) were dissolved in 400 parts of monochlorobenzene to prepare a coating liquid. The coating liquid was applied onto the above-prepared CGL by dipping and dried for 1 hour at 120° C. to form a CTL having a thickness of 20 μm, whereby an electrophotographic photosensitive member according to the present invention was prepared.

The thus prepared photosensitive member was assembled in an electrophotographic copying machine using a normal development system and was subjected to an image formation process including the steps of: charging-exposure-development-transfer-cleaning at a cycle speed of 0.8 sec/cycle. Under environmental conditions including low-temperature (15° C.) and low-humidity (15% RH) condition (hereinbelow, simply referred to as "LtLh condition") and high-temperature (30° C.) and high-humidity (85% RH) condition (hereinbelow, simply referred to as "HtHh condition"), the above copying machine was subjected to successive image formation of 10000 sheets (a durability test). In order to evaluate electrophotographic characteristics, dark part potentials ($V_D$) at an initial stage and after copying of 10000 sheets and light part potentials ($V_L$) at an initial stage and after copying of 10000 sheets were measured under LtLh and HtHh conditions, respectively. The results are shown in Table 1 below.

TABLE 1

| | LtLh condition | | HtHh condition | |
|---|---|---|---|---|
| | Initial | After $10^4$ sheets | Initial | After $10^4$ sheets |
| $V_D$ (−V) | 700 | 700 | 700 | 680 |
| $V_L$ (−V) | 210 | 215 | 210 | 205 |

As shown in Table 1, the photosensitive member according to the present invention provided potential stabilities (i.e., substantially provided no changes in $V_D$ and $V_L$) under the LtLh condition and the HtHh condition, thus retaining large differences between $V_D$ and $V_L$ at the initial stage and after the copying of 10000 sheets. As a result, a sufficient contrast and a stable image quality were obtained.

EXAMPLE 2

A photosensitive member of the present invention was prepared in the same manner as in Example 1 except that the aluminum cylinder was changed to one having an outer diameter of 30 mm and a length of 260 mm.

The thus prepared photosensitive member was assembled in an electrophotographic copying machine using a reversal development system and was subjected to an image formation process including the steps of: charging-exposure-development-transfer-cleaning at a cycle speed of 6 sec/cycle. Under environmental conditions including LtLh condition and HtHh condition, the above copying machine was subjected to successive image formation of 5000 sheets (a durability test). In order to evaluate electrophotographic characteristics, dark part potentials ($V_D$) at an initial stage and after copying of 5000 sheets and light part potentials ($V_L$) at an initial stage and after copying of 5000 sheets were measured under LtLh and HtHh conditions, respectively. The results are shown in Table 2 below.

TABLE 2

| | LtLh condition | | HtHh condition | |
|---|---|---|---|---|
| | Initial | After 5000 sheets | Initial | After 5000 sheets |
| $V_D$ (−V) | 700 | 695 | 700 | 690 |

TABLE 2-continued

| | LtLh condition | | HtHh condition | |
|---|---|---|---|---|
| | Initial | After 5000 sheets | Initial | After 5000 sheets |
| $V_L$ (−V) | 210 | 210 | 210 | 215 |

As shown in Table 2, the photosensitive member according to the present invention provided potential stabilities under the LtLh condition and the HtHh condition, thus retaining large differences between $V_D$ and $V_L$ at the initial stage and after the copying of 5000 sheets. As a result, a sufficient contrast and a stable image quality were obtained. Further, resultant images were free from back spots or fogs.

EXAMPLES 3–6

Four photosensitive members of the present invention were prepared in the same manner as in Example 1 except that the coating liquid for the intermediate layer prepared in Example 1 was changed to those comprising the following ingredients, respectively.

Coating Liquid (Example 3)

| | |
|---|---|
| Coated powder comprising barium sulfate fine particles having a coating layer of tin oxide containing fluorine (particle size: 0.27 μm, coating ratio: 50 wt. %, fluorine content: 9 wt. %, | 150 parts |

-continued

| | |
|---|---|
| powder resistivity: 40 ohm.cm) | |
| Phenolic resin (the same as in Example 1) | 70 parts |
| 2-methoxy-1-propanol | 100 parts |

Coating Liquid (Example 4)

| | |
|---|---|
| Coated powder comprising barium sulfate fine particles having a coating layer of tin oxide containing antimony (Pastran IV, mfd. by Mitsui Kinzoku Kogyo K.K.; particle size: 0.25 μm, coating ratio: 50 wt. %, antimony content: 9 wt. %, powder resistivity: 30 ohm.cm) | 100 parts |
| Phenolic resin (the same as in Example 1) | 70 parts |
| 2-methoxy-1-propanol | 80 parts |

Coating Liquid (Example 5)

| | |
|---|---|
| Coated powder (the same as in Example 1) | 120 parts |
| Polyester polyurethane (Nipporan 2304, mfd. by Nippon Polyurethane K.K.) | 70 parts |
| 2-methoxy-1-propanol | 100 parts |

Coating Liquid (Example 6)

| | |
|---|---|
| Coated powder (the same as in Example 3) | 100 parts |
| Polyamide acid resin of the formula below (weight-average molecular weight: 8500): | 50 parts |

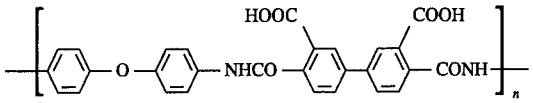

| | |
|---|---|
| N,N-dimethylacetamide | 170 parts |

The thus prepared photosensitive members were subjected to a durability test in the same manner as in Example 1 to evaluate a potential stability.

The results are shown in Table 3 below.

TABLE 3

| Example | LtLh condition | | | | HtHh condition | | | |
|---|---|---|---|---|---|---|---|---|
| | Initial | | After $10^4$ sheets | | Initial | | After $10^4$sheets | |
| No. | $V_D$ (−V) | $V_L$ (−V) | $V_D$ (−V) | $V_L$ (−V) | $V_D$ (−V) | $V_L$ (−V) | $V_D$ (−V) | $V_L$ (−V) |
| 3 | 700 | 200 | 700 | 205 | 700 | 195 | 690 | 190 |
| 4 | 695 | 190 | 700 | 190 | 695 | 190 | 690 | 190 |
| 5 | 710 | 200 | 705 | 200 | 705 | 200 | 700 | 200 |
| 6 | 700 | 195 | 700 | 205 | 700 | 190 | 695 | 190 |

As shown in Table 3, the photosensitive members according to the present invention provided potential stabilities under the LtLh condition and the HtHh condition, thus retaining large differences between $V_D$ and $V_L$ at the initial stage and after the copying of 1000 sheets. As a result, a sufficient contrast and a stable image quality were obtained.

Comparative Examples 1 and 2

Two photosensitive members of the present invention were prepared in the same manner as in Example 1 except that the coating liquid for the intermediate layer prepared in Example 1 was changed to those comprising the following ingredients, respectively.

Coating Liquid (Comparative Example 1)

| | |
|---|---|
| Coated powder comprising titanium oxide fine particles having a coating layer of tin oxide containing antimony (ECTT-1, mfd. by Titan Kogyo K.K.; particle size: 0.25 μm) | 150 parts |
| Phenolic resin (the same as in | 75 parts |

-continued

| | |
|---|---|
| Example 1) | |
| Methyl cellosolve | 60 parts |
| Methanol | 15 parts |

Coating Liquid (Comparative Example 2)

| | |
|---|---|
| Powder comprising tin oxide fine particles containing antimony (T-1, mfd. by Mitsubishi Material K.K.; particle size: 0.20 μm) | 100 parts |
| Polyester polyurethane (the same as in Example 5) | 70 parts |
| 2-methoxy-1-propanol | 80 parts |

The thus prepared photosensitive members were subjected to a durability test in the same manner as in Example 1 to evaluate a potential stability.

The results are shown in Table 4 below.

TABLE 4

| Comp. | LtLh condition | | | | HtHh condition | | | |
|---|---|---|---|---|---|---|---|---|
| Example | Initial | | After $10^4$ sheets | | Initial | | After $10^4$ sheets | |
| No. | $V_D$ (−V) | $V_L$ (−V) | $V_D$ (−V) | $V_L$ (−V) | $V_D$ (−V) | $V_L$ (−V) | $V_D$ (−V) | $V_L$ (−V) |
| 1 | 700 | 190 | 680 | 295 | 700 | 190 | 640 | 165 |
| 2 | 695 | 195 | 640 | 290 | 700 | 200 | 650 | 170 |

As apparent from the above results, the two photosensitive members provided large differences between $V_D$ and $V_L$ under LtLh and HtHh conditions at the initial stage, thus providing a sufficient contrast. However, after the copying of 10000 sheets, the two photosensitive m embers showed a remarkable decrease in $V_D$ under LtLh and HtHh conditions and also showed a considerable increase in $V_L$ under LtLh condition, thus failing to provide a sufficient contrast and a stable image quality.

EXAMPLES 7–10

Four photosensitive members were prepared in the same manner as in Examples 3–6, respectively (e.g., Example 7 corresponds to Example 3), except that each of the aluminum cylinder was changed to one having an outer diameter of 30 mm and a length of 260 min.

The thus prepared photosensitive members were subjected to a durability test in the same manner as in Example 2 to evaluate a potential stability.

The results are shown in Table 5 below.

TABLE 5

| | LtLh condition | | | | HtHh condition | | | |
|---|---|---|---|---|---|---|---|---|
| Example | Initial | | After 5000 sheets | | Initial | | After 5000 sheets | |
| No. | $V_D$ (−V) | $V_L$ (−V) | $V_D$ (−V) | $V_L$ (−V) | $V_D$ (−V) | $V_L$ (−V) | $V_D$ (−V) | $V_L$ (−V) |
| 7 | 700 | 195 | 695 | 200 | 690 | 190 | 685 | 190 |
| 8 | 700 | 200 | 690 | 205 | 695 | 190 | 690 | 190 |
| 9 | 695 | 195 | 690 | 200 | 700 | 195 | 700 | 190 |
| 10 | 695 | 190 | 690 | 195 | 700 | 195 | 700 | 200 |

As shown in Table 5, the photosensitive member according to the present invention provided potential stabilities under the LtLh condition and the HtHh condition, thus retaining large differences between $V_D$ and $V_L$ at the initial stage and after the copying of 5000 sheets. As a result, a sufficient contrast and a stable image quality were obtained. Further, resultant images were free from black spots or fogs.

Comparative Examples 3 and 4

Two photosensitive members were prepared in the same manner as in Comparative Examples 1 and 2, respectively (e.g., Comparative Example 3 corresponds to Comparative Example 1), except that each of the aluminum cylinder was changed to one having an outer diameter of 30 mm and a length of 260 mm.

The thus prepared photosensitive members were subjected to a durability test in the same manner as in Example 1 to evaluate a potential stability.

The results are shown in Table 6 below.

TABLE 6

| Comp. | LtLh condition | | | | HtHh condition | | | |
|---|---|---|---|---|---|---|---|---|
| Example | Initial | | After 5000 sheets | | Initial | | After 5000 sheets | |
| No. | $V_D$ (−V) | $V_L$ (−V) | $V_D$ (−V) | $V_L$ (−V) | $V_D$ (−V) | $V_L$ (−V) | $V_D$ (−V) | $V_L$ (−V) |
| 3 | 695 | 200 | 680 | 225 | 690 | 200 | 595 | 170 |
| 4 | 700 | 190 | 670 | 205 | 705 | 195 | 560 | 180 |

As apparent from the above results, the two photosensitive members provided large differences between $V_D$ and $V_L$ under LtLh and HtHh conditions at the initial stage, thus providing a sufficient contrast. However, after the copying of 5000 sheets, the two photosensitive m embers showed a remarkable decrease in $V_D$ under HtHh condition.

Further, under HtHh condition, the two photosensitive members provided the recording material with undesirable black spots all through the durability test (i.e., from the initial stage to after the copying of 5000 sheets).

EXAMPLE 11

An intermediate layer having a thickness of 5 μm (after drying) was prepared by applying a coating liquid identical to the coating liquid used in Example 1 onto an aluminum cylinder identical to the cylinder used in Example 1 by dipping, followed by drying for 30 minutes at 140° C.

Then, 5 parts of a bisazo pigment represented by the following formula:

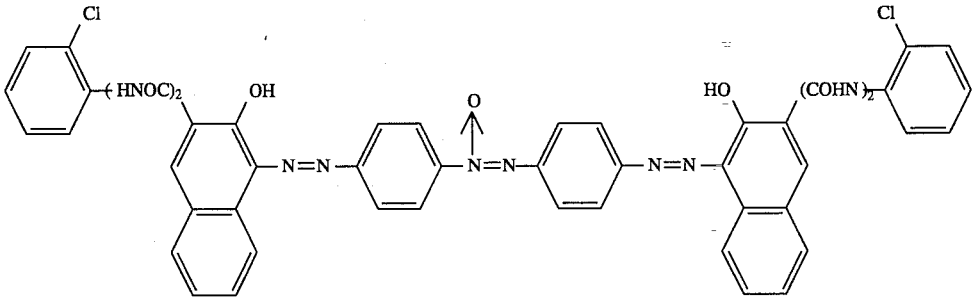

was dispersed in 90 parts of tetrahydrofuran (THF) for 20 hours by a sand mill. To the dispersion, a solution of 2.5 parts of a polyvinyl butyral resin (BLS, mfd. by Sekisui Kagaku Kogyo K.K.; butyral degree of 80%) in 20 parts of THF was added, followed by stirring for 2 hours. The resultant mixture was diluted with a mixture solvent of 100 parts of cyclohexanone and 100 parts of THF to prepare a coating liquid. The coating liquid was applied onto the above-prepared intermediate layer by wire bar coating, followed by drying to form a CGL having a thickness of 0.2 μm.

Subsequently, 50 parts of a styryl compound represented by the following formula:

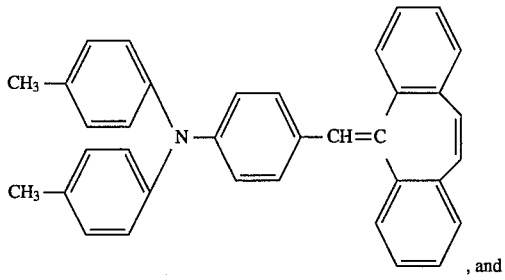

, and 50 parts of a polycarbonate resin (Iupilon Z-200, mfd. by Mitsubishi Gas Kagaku K.K.) were dissolved in 400 parts of monochlorobenzene to prepare a coating liquid. The coating liquid was applied onto the above-prepared CGL by dipping and dried for 1 hour at 120° C. to form a CTL having a thickness of 20 μm, whereby a photosensitive member was prepared of the present invention.

The thus prepared photosensitive members were subjected to a durability test in the same manner as in Example 1 to evaluate a potential stability.

The results are shown in Table 7 below.

TABLE 7

| | LtLh condition | | HtHh condition | |
|---|---|---|---|---|
| | Initial | After $10^4$ sheets | Initial | After $10^4$ sheets |
| $V_D$ (−V) | 700 | 690 | 700 | 685 |
| $V_L$ (−V) | 200 | 195 | 200 | 205 |

As shown in Table 7, the photosensitive member according to the present invention provided potential stabilities under the LtLh condition and the HtHh condition, thus retaining large differences between $V_D$ and $V_L$ at the initial stage and after the copying of 1000 sheets. As a result, a sufficient contrast and a stable image quality were obtained.

EXAMPLE 12

A photosensitive member was prepared in the same manner as in Example 11 except for using a coating liquid identical to the one for use in the intermediate layer prepared in Example 3.

The thus prepared photosensitive members were subjected to a durability test in the same manner as in Example 1 to evaluate a potential stability.

The results are shown in Table 8 below.

TABLE 8

| | LtLh condition | | HtHh condition | |
|---|---|---|---|---|
| | Initial | After $10^4$ sheets | Initial | After $10^4$ sheets |
| $V_D$ (–V) | 705 | 700 | 700 | 690 |
| $V_L$ (–V) | 210 | 205 | 210 | 210 |

As shown in Table 8, the photosensitive member according to the present invention provided potential stabilities under the LtLh condition and the HtHh condition, thus retaining large differences between $V_D$ and $V_L$ at the initial stage and after the copying of 1000 sheets. As a result, a sufficient contrast and a stable image quality were obtained.

As described hereinabove, according to the present invention, there is provided an electrophotographic photosensitive member characterized by a specific intermediate layer comprising barium sulfate fine particles coated with a coating layer comprising tin oxide. The photosensitive member can provide stable potential properties (potential stability) and good image forming properties (high quality images) under overall environmental conditions from low-temperature and low-humidity condition.

Accordingly, the photosensitive member is usable for constituting an electrophotographic apparatus capable of forming good and stable images even under any environmental condition.

What is claimed is:

1. An electrophotographic photosensitive member comprising: a support, and an intermediate layer and a photosensitive layer disposed on the support in this order; wherein the intermediate layer comprises a coated powder having a resistivity of 0.1 to 1,000 ohm.cm comprising barium sulfate fine particles coated with a coating layer comprising tin oxide having a reduced oxygen content.

2. A member according to claim 1, wherein the coating layer has a coating ratio of 10–80 wt. %.

3. A member according to claim 2, wherein the coating layer has a coating ratio of 30–60 wt. %.

4. A member according to claim 1, wherein the coating layer comprises fluorine or antimony.

5. A member according to claim 4, wherein the coating layer comprises 0.01 to 30 wt. % of fluorine or antimony.

6. A member according to claim 5, wherein the coating layer comprises 0.1 to 10 wt. % of fluorine or antimony.

7. A member according to claim 1, wherein the intermediate layer contains a binder resin which is selected from the group consisting of phenolic resin, polyurethane resin, polyamide, polyimide, polyamide-imide, polyamide acid resin, polyvinyl acetal, epoxy resin, acrylic resin, melamine resin and polyester.

8. A member according to claim 7, wherein the binder resin is selected from the group consisting of phenolic resin, polyurethane resin and polyamide acid resin.

9. A member according to claim 1, which further comprises a barrier layer disposed between the intermediate layer and the photosensitive layer.

10. A device unit comprising an electrophotographic photosensitive member according to claim 1 and at least one means selected from a charger, a developing means and a cleaner.

11. An electrophotographic apparatus, comprising: an electrophotographic photosensitive member, charging means for charging the photosensitive member, image exposure means for performing image exposure to the charged photosensitive member to form an electrostatic latent image on the photosensitive member, and developing means for developing the latent image with a toner wherein the electrophotographic photosensitive member comprises a support, and an intermediate layer and a photosensitive layer disposed on the support in this order; wherein the intermediate layer is comprised of a coated powder having a resistivity of 0.1 to 1,000 ohm.cm; and, wherein the coated powder is comprised of barium sulfate fine particles coated with a coating layer comprised of tin oxide having a reduced oxygen content.

12. An electrophotographic photosensitive member comprising: a support, and an intermediate layer and a photosensitive layer disposed on the support in this order; wherein the intermediate layer comprises a coated powder comprising barium sulfate fine particles coated with a coating layer comprising tin oxide having a reduced oxygen content.

13. A member according to claim 12, wherein the coating layer has a coating ratio of 10–80 wt. %.

14. A member according to claim 13, wherein the coating layer has a coating ratio of 30–60 wt. %.

15. A member according to claim 12, wherein the coating layer comprises fluorine or antimony.

16. A member according to claim 15, wherein the coating layer comprises 0.10 to 30 wt. % of fluorine or antimony.

17. A member according to claim 16, wherein the coating layer comprises 0.1 to 10 wt. % of fluorine or antimony.

18. A member according to claim 12, wherein the intermediate layer contains a binder resin which is selected from the group consisting of phenolic resin, polyurethane resin, polyamide, polyimide, polyamideimide, polyamide acid resin, polyvinyl acetal, epoxy resin, acrylic resin, melamine resin and polyester.

19. A member according to claim 18, wherein the binder resin is selected from the group consisting of phenolic resin, polyurethane resin and polyamide acid resin.

20. A member according to claim 12, which further comprises a barrier layer disposed between the intermediate layer and the photosensitive layer.

21. A device unit comprising an electrophotographic photosensitive member according to claim 12 and at least one means selected from a charger, a developing means and a cleaner.

22. An electrophotographic photosensitive member comprising: a support, and an intermediate layer and a photosensitive layer disposed on the support in this order; wherein the intermediate layer comprises a coated powder comprising fine particles coated with a coating layer comprising metal oxide having a decreased oxygen content.

23. The member of claim 22, wherein said metal oxide has an electroconductivity sufficient to provide said coated powder with a resistivity of 0.1 to 1,000 ohm.cm.

24. A member according to claim 22, wherein the coating layer has a coating ratio of 10–80 wt. %.

25. A member according to claim 24, wherein the coating layer has a coating ratio of 30–60 wt. %.

26. A member according to claim 22, wherein the coating layer comprises fluorine or antimony.

27. A member according to claim 26, wherein the coating layer comprises 0.10 to 30 wt. % of fluorine or antimony.

28. A member according to claim 27, wherein the coating layer comprises 0.1 to 10 wt. % of fluorine or antimony.

29. A member according to claim 22, wherein the intermediate layer contains a binder resin which is selected from the group consisting of phenolic resin, polyurethane resin, polyamide, polyimide, polyamideimide, polyamide acid resin, polyvinyl acetal, epoxy resin, acrylic resin, melamine resin and polyester.

30. A member according to claim 29, wherein the binder resin is selected from the group consisting of phenolic resin, polyurethane resin and polyamide acid resin.

31. A member according to claim 22, which further comprises a barrier layer disposed between the intermediate layer and the photosensitive layer.

32. A device unit comprising an electrophotographic photosensitive member according to claim 22 and at least one means selected from a charger, a developing means and a cleaner.

33. An electrophotographic apparatus comprising: an electrophotographic photosensitive member, charging means for charging the photosensitive member, image exposure means for performing image exposure to the charged photosensitive member to form an electrostatic latent image on the photosensitive member and developing means for developing the latent image with a toner, wherein the electrophotographic photosensitive member comprises a support, an intermediate layer and a photosensitive layer disposed on the support in this order; wherein the intermediate layer is comprised of a coated powder comprising barium sulfate fine particles coated with a coating layer comprised of tin oxide having a reduced oxygen content.

34. An electrophotographic apparatus comprising an electrophotographic photosensitive member, charging means for charging the photosensitive member, image exposure means for performing image exposure to the charged photosensitive member to form an electrostatic latent image on the photosensitive member and developing means for developing the latent image with a toner, wherein the electrophotographic photosensitive member comprises a support, an intermediate layer and a photosensitive layer disposed on the support in this order; wherein the intermediate layer is comprised of a coated powder comprising fine particles coated with a coating layer comprising metal oxide having a decreased oxygen content.

* * * * *

UNITED STATES PATENT AND TRADEMARK OFFICE

CERTIFICATE OF CORRECTION

PATENT NO. : 5,488,461

DATED : January 30, 1996

INVENTOR(S) : SHINTETSU GO ET AL.

It is certified that error appears in the above-identified patent and that said Letters Patent is hereby corrected as shown below:

Title page:

AT [56] REFERENCES CITED

U.S. Patent Documents,
"4,949,690 8/1990 Hisamura et al." should read
--4,948,690 8/1990 Hisamura et al.--.

COLUMN 1

Line 43, "reedy" should read --remedy--.

COLUMN 2

Line 66, "FIGURE 1" should read --FIG. 1--.

COLUMN 6

Line 29, "FIGURE 1" should read --FIG. 1--.
Line 32, "FIGURE 1," should read --FIG. 1,--.

COLUMN 7

Line 15, "in" should be deleted.
Line 65, "50 parts" should read --, and 50 parts--.

COLUMN 9

Line 15, "back" should read --black-- and
"fogs." should read --fog.--.

UNITED STATES PATENT AND TRADEMARK OFFICE

CERTIFICATE OF CORRECTION

PATENT NO. : 5,488,461

DATED : January 30, 1996

INVENTOR(S) : SHINTETSU GO ET AL.

It is certified that error appears in the above-identified patent and that said Letters Patent is hereby corrected as shown below:

COLUMN 11

Line 36, "m embers" should read --members--.
Line 47, "cylinder" should read --cylinders--.
Line 48, "260 min." should read --260 mm.--.

COLUMN 12

Line 7, "fogs." should read --fog.--.
Line 14, "cylinder" should read --cylinders--.

COLUMN 13

Line 16, "m embers" should read --members--.

COLUMN 16

Line 24, "reduced" should read --decreased--.
Line 32, "0.10" should read --0.01--.
Line 67, "0.10" should read --0.01--.

UNITED STATES PATENT AND TRADEMARK OFFICE

CERTIFICATE OF CORRECTION

PATENT NO. : 5,488,461

DATED : January 30, 1996

INVENTOR(S) : SHINTETSU GO ET AL.

It is certified that error appears in the above-identified patent and that said Letters Patent is hereby corrected as shown below:

COLUMN 18

Line 8, "reduced" should read --decreased--.

Signed and Sealed this

Thirtieth Day of July, 1996

Bruce Lehman

*Attest:*

BRUCE LEHMAN

*Attesting Officer*

*Commissioner of Patents and Trademarks*